US007893672B2

(12) United States Patent
Scoones et al.

(10) Patent No.: US 7,893,672 B2
(45) Date of Patent: Feb. 22, 2011

(54) TECHNIQUE TO IMPROVE DROPOUT IN LOW-DROPOUT REGULATORS BY DRIVE ADJUSTMENT

(75) Inventors: Kevin Scoones, Dallas, TX (US); Anmol Sharma, Freising (DE)

(73) Assignee: Texas Instruments Deutschland GmbH, Freising (DE)

( * ) Notice: Subject to any disclaimer, the term of this patent is extended or adjusted under 35 U.S.C. 154(b) by 111 days.

(21) Appl. No.: 12/397,903

(22) Filed: Mar. 4, 2009

(65) Prior Publication Data

US 2009/0322295 A1 Dec. 31, 2009

Related U.S. Application Data

(60) Provisional application No. 61/141,422, filed on Dec. 30, 2008.

(30) Foreign Application Priority Data

Mar. 4, 2008 (DE) ..... 10 2008 012 392

(51) Int. Cl.
*G05F 1/00* (2006.01)

(52) U.S. Cl. ..... 323/280; 323/281

(58) Field of Classification Search ..... 323/281, 323/280, 274, 279

See application file for complete search history.

(56) References Cited

U.S. PATENT DOCUMENTS

| | | | | |
|---|---|---|---|---|
| 6,246,221 | B1 * | 6/2001 | Xi | 323/280 |
| 6,600,299 | B2 * | 7/2003 | Xi | 323/280 |
| 6,646,495 | B2 | 11/2003 | Perez | |
| 6,791,303 | B2 * | 9/2004 | Klotz et al. | 323/274 |
| 7,106,033 | B1 * | 9/2006 | Liu et al. | 323/280 |
| 7,560,915 | B2 * | 7/2009 | Ito et al. | 323/282 |

FOREIGN PATENT DOCUMENTS

DE 10 2005 039 114 2/2007

OTHER PUBLICATIONS

"CMOS Analog Circuit Design," Oxford University Press, (Phillip E. Allen and Douglas R. Holberg), pp. 415-420.

* cited by examiner

*Primary Examiner*—Shawn Riley
(74) *Attorney, Agent, or Firm*—John J. Patti; Wade J. Brady, III; Frederick J. Telecky, Jr.

(57) ABSTRACT

An electronic device includes a low drop-out regulator for providing a regulated output voltage. The low drop-out regulator generally comprises a power MOSFET transistor having a gate coupled to a driver. The driver has a first path including an NMOS transistor and being coupled to the gate of the power MOSFET, a second path having a PMOS transistor and being coupled to the gate of the power MOSFET, and a switch for alternately switching between the first and second paths so as to provide a voltage to the gate of the power MOSFET ranging from ground to a power supply level.

6 Claims, 1 Drawing Sheet

TECHNIQUE TO IMPROVE DROPOUT IN LOW-DROPOUT REGULATORS BY DRIVE ADJUSTMENT

CROSS-REFERENCE TO RELATED APPLICATIONS

This application claims priority to German Patent Application No. 10 2008 012 392.7, entitled "A Technique to Improve Dropout in Low-Dropout Regulators by Drive Adjustment," filed on Mar. 4, 2008, which is hereby incorporated by reference for all purposes.

TECHNICAL FIELD

The invention relates generally to an electronic device having a low dropout regulator (LDO) for providing a regulated output voltage and, more particularly, to a driver for improving dropout in an LDO.

BACKGROUND

A low dropout regulator (LDO) is a DC linear voltage regulator comprising a power MOSFET transistor for regulating the voltage supplied to a load, for example in a portable device. An LDO has a very small drop-out, or voltage differential, between the supply voltage node and the regulated output node. The larger the dropout, the higher the power supply voltage must be. In small portable electronic devices, where power is at a premium, it is desirable that the dropout be as small as possible. However, to achieve a small drop-out, a power transistor having a large area is usually required. Integrated circuit space, though, is also at a premium; therefore, increasing the size of the power transistor is not a generally feasible solution. An improvement in drop-out by increasing the power transistor size can potentially lead to a higher quiescent current, which is not desirable in portable products and limits the efficiency of the LDO. Improving the dropout by increasing the power transistor size also provides an increased current leakage when no load is present but if it is attempted to reduce the current leakages, the drop-out performance deteriorates.

SUMMARY

Accordingly, a preferred embodiment of the present invention provides an electronic device including a low drop-out regulator for providing a regulated output voltage. The low drop-out regulator generally comprises a power MOSFET transistor having a gate coupled to a driver. The driver generally comprises a first path having an NMOS transistor, with the first path being coupled to the gate of the power MOSFET. A second path is also provided that has a PMOS transistor and is coupled to the gate of the power MOSFET. Further, the driver generally comprises a switch for alternately switching between the first and second paths so as to provide a voltage to the gate of the power MOSFET ranging from ground to a power supply level. A regulated output voltage is provided by the power MOSFET transistor to the output voltage node of the LDO. In order to supply this regulated output voltage, the gate terminal of the power MOSFET should be driven, for example, so that it is pulled down to ground when its output (the output node of the LDO) is coupled to a high load (i.e. the load has only a small resistance) and pulled to the power supply voltage rail when its output is coupled to a low load (i.e. the load has a large resistance). In other words, the power MOSFET is fully open when the LDO is required to regulate the voltage supplied to a high load.

To achieve this, a preferred embodiment of the present invention provides that the gate of the power MOSFET is connected to a driver having two parallel paths. The paths may or may not be individually load dependent. Both paths are coupled to the gate of the power MOSFET. For supplying a high load, for example, the first path, which comprises an NMOS transistor, is used to drive the gate of the power MOSFET. However, when the load to be supplied by the LDO is low, or there is no load, the driver is switched from the first path to a second path, comprising a PMOS transistor, which is then used to provide a driving voltage to the power MOSFET. Only one of the paths is active at any one time. In this way, the voltage dropout is improved, while also reducing the area required for the power MOSFET. An important aspect of a preferred embodiment of the present invention is that a two stage control mechanism for the power MOSFET is provided that covers a larger voltage range of the gate voltage. Furthermore, leakage current is reduced, hence the battery life is increased, and no additional quiescent current is added to the device. As explained above, it has previously not been possible to both reduce leakage current and improve dropout performance in LDO regulators. This means that the device of the present invention has an improved performance (increased efficiency) and lower production cost compared to existing LDO devices.

Preferably, the switch generally comprises a first switch and a second switch, the first path comprises a first current regulator coupled between the first switch and the NMOS transistor and the second path generally comprises a second current regulator coupled between the second switch and the PMOS transistor. A control stage may also be provided for controlling the first and second switches to switch from the first path to the second path when a voltage at the gate of the power MOSFET increases above a reference level. For example, when the load at the output node of the LDO is high, the NMOS transistor in the first path is activated by adapting the control stage to close (switch on) the first switch. By switching on the first switch, the channel in the NMOS transistor opens and current can flow through, thereby switching on the NMOS transistor. The control stage is adapted so that the second switch and the PMOS transistor in the second path are automatically switched off by this. The NMOS transistor provides a level shift down, thereby increasing the drive to the gate of the power MOSFET. In other words, the voltage at the gate of the power MOSFET is pulled towards ground. However, if there is a small load or no load, for example, the second switch is instead activated, which switches on the PMOS transistor in the second path. The current regulators in each path may or not be load dependent but if, for example, the current regulator in the first path is load dependent, there will be an increase in level shifting at high loads, which further increases the drive of the power MOSFET.

Additionally, the control stage generally comprises a comparator for comparing the voltage at the gate of the power MOSFET with a reference voltage and providing an output for controlling the first and second switches based on the comparison. Accordingly, one input of the comparator is coupled to the gate of the power MOSFET and senses its gate voltage. The other input of the comparator is at a reference voltage level and its output is coupled to the first and second switches. For the power MOSFET to fully open (i.e., at high loads), its gate voltage is required to be at ground so that the first switch is closed and current flows through the NMOS transistor (the first path), for example. When the voltage comparison performed by the comparator indicates that the gate voltage of the power MOSFET has increased above the predetermined reference level, the comparator outputs a control signal, which controls the first switch to open and the second switch to close. This means that current flows through the PMOS transistor (the second path) instead of the NMOS transistor. Thus the control signal output from the comparator controls the first and second switches to alternately switch between the first and second paths in accordance with the drive requirements of the power (MOSFET); i.e, the load supplied by the LDO. The comparator may have an internal hysteresis, which changes the switching point from the first path to the second path relative to that from the second path to the first path. This avoids premature switching and reduces noise in the switching cycle between the first and second paths.

Preferably, an error amplifier is provided that has an output coupled to gates of the NMOS and PMOS transistors for comparing an output voltage at an output node of the LDO to a reference voltage and providing a gate voltage to the NMOS and PMOS transistors based on the comparison. The output node of the LDO is coupled in a feedback connection to an input of the error amplifier, with the other input of the error amplifier being operable to receive a reference voltage.

In accordance with a preferred embodiment of the present invention, an apparatus for providing an output current and an output voltage to a load is provided. The apparatus comprises a power transistor that is adapted to be coupled to a load; a measuring circuit that is coupled to the power transistor, wherein the measuring circuit generates a feedback voltage; an error amplifier that is coupled to the measuring circuit, wherein the error amplifier compares the feedback voltage to a reference voltage; an NMOS transistor that is coupled to the error amplifier at its gate and that is coupled to the control electrode at its source on a switching node; a PMOS transistor that is coupled to the switching node at its source and that is coupled to the error amplifier at its gate; a charge pump that is coupled the switching node; and a controller that is coupled to the sources of the NMOS and PMOS transistors and to the charge pump, wherein the controller provides a control signal to the charge pump based at least in part on a voltage at the switching node.

In accordance with a preferred embodiment of the present invention, the power transistor is a PMOS transistor.

In accordance with a preferred embodiment of the present invention, the charge pump further comprises: a first switch that is actuated and deactuated by the control signal; a first current source that is coupled between the first switch and the switching node; a second switch that is actuated and deactuated by the control signal, wherein the second switch is actuated when the first switch is deactuated, and wherein the second switch is deactuated when the first switch is actuated; and a second current source that is coupled between the second switch and the switching node.

In accordance with a preferred embodiment of the present invention, the controller further comprises a comparator having a hysteresis, wherein the comparator compares the voltage at the switching node to a second reference voltage.

In accordance with a preferred embodiment of the present invention, the measuring circuit further comprises a voltage divider.

In accordance with a preferred embodiment of the present invention, an apparatus for providing an output current and an output voltage to a load is provided. The apparatus comprises a first voltage rail; a second voltage rail; a first PMOS transistor that is coupled to the first rail at its source and that is adapted to be coupled to the load at its drain; a measuring circuit that is coupled to the power transistor, wherein the measuring circuit generates a feedback voltage; an error amplifier that is coupled to the measuring circuit, wherein the error amplifier compares the feedback voltage to a first reference voltage; an NMOS transistor that is coupled to the error amplifier at its gate, that is coupled to the first voltage rail at its drain, and that is coupled to the control electrode at its source on a switching node; a PMOS transistor that is coupled to the switching node at its source, that is coupled to the second voltage rail at its drain, and that is coupled to the error amplifier at its gate; a first switch that is coupled to the first voltage rail; a first current source that is coupled between the first switch and the switching node; a second switch that is coupled to the second voltage rail; a second current source that is coupled between the second switch and the switching node; and a comparator having a hysteresis, wherein the comparator is coupled to switching node, wherein the comparator compares a voltage at the switching node to a second reference voltage to generate a control signal that is provided to the first and second switches, and wherein the control signal is provided such that the second switch is actuated when the first switch is deactuated and the second switch is deactuated when the first switch is actuated.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
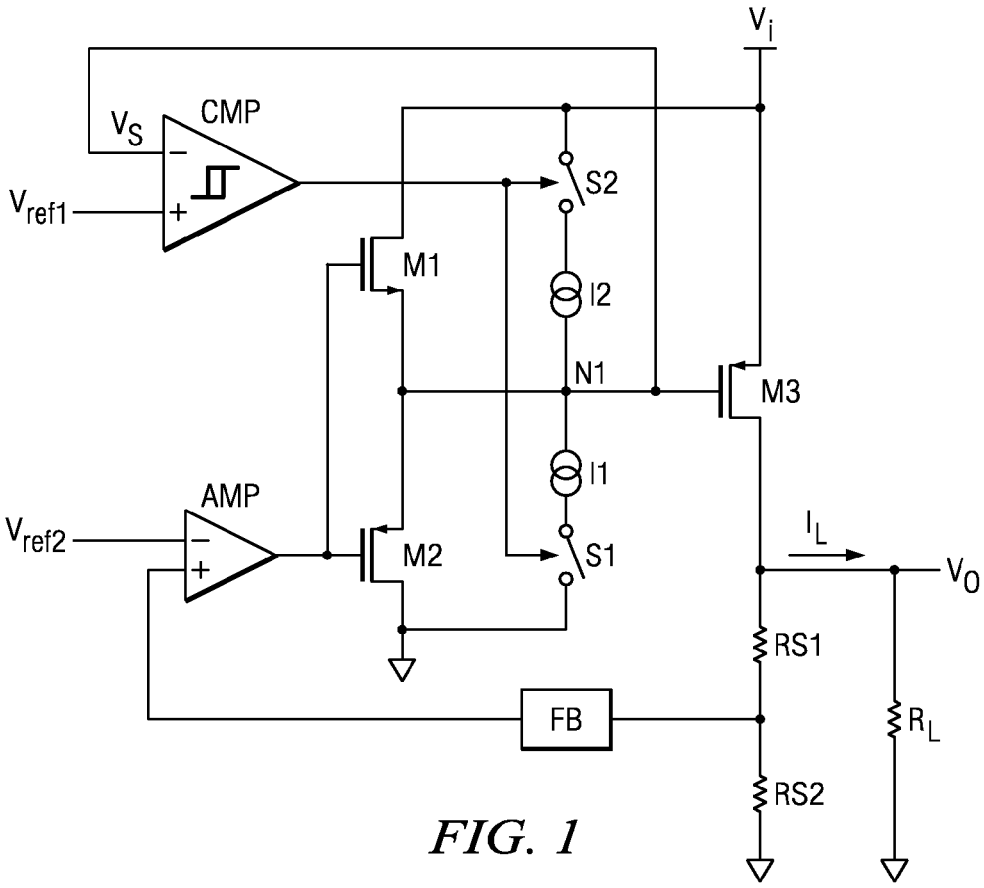
FIG. 1 is a simplified circuit diagram of an electronic device with a low dropout regulator according a preferred embodiment of the present invention.

Refer now to the drawings wherein depicted elements are, for the sake of clarity, not necessarily shown to scale and wherein like or similar elements are designated by the same reference numeral through the several views.

FIG. 1 shows an electronic device having a low dropout regulator (LDO) according to a preferred embodiment of the present invention. The LDO is generally formed by a power MOSFET transistor M3 having its source terminal coupled to an input voltage node Vi, for example a power supply rail, and its drain terminal coupled to an output node Vo of the LDO. The LDO is operable to provide a regulated output voltage derived from the power supply at the input node Vi to a load coupled to the output node Vo, which is represented here by a load resistor $R_L$. Depending on the size of the load $R_L$, the power MOSFET M3 will require to be driven by a range of voltages supplied to its gate terminal, varying between ground and the voltage level at the input node Vi. For example, in the case of a high load, the gate terminal of the power MOSFET M3 will need to be close to ground so that it can fully open and supply a high load current $I_L$ to the load $R_L$.

In order to achieve driving of the power MOSFET M3 at a range of voltages, the gate terminal of the power MOSFET M3 is coupled to driving circuitry including an NMOS transistor M1 and a PMOS transistor M2 having interconnected source terminals. The drain terminals of the transistors M1 and M2 are coupled to the input node Vi and ground, respectively. Although the transistors M1 and M2 are interconnected, they in fact form components of two different, parallel current paths. The first path, as well as the NMOS transistor M1, includes a switch S1 and a current regulator I1. The second path includes the PMOS transistor M2, as well as a switch S2 and a current regulator I2. The interconnection, or crossing point, of the first and second paths is provided at a node N1, which is a connection point of the current regulators I1 and I2 and the source terminals of the transistors M1 and M2. However, only one of the paths is used at a time. Gate terminals of the transistors M1 and M2 are coupled to the output of a differential or error amplifier AMP, which is operable to provide the gate voltage to the transistors M1 and M2. The output node Vo of the LDO is coupled in a feedback connection FB to a positive input of the amplifier AMP, with its negative input being connected to a reference voltage Vref2. Thus the gate voltages of the transistors M1 and M2 are also determined by the load. A resistor divider that is generally comprised of resistors RS1 and RS2 is also coupled in the feedback connection FB for sensing the voltage Vout. The switches S1 and S2 are coupled to the output of a comparator CMP, which is adapted to provide a control signal for opening and closing the switches S1 and S2. The comparator CMP is provided with an internal hysteresis for suppressing undesired switching between the two paths and thereby for reducing noise in the switching cycle between S1 and S2. The negative input terminal of the comparator CMP is coupled to the gate terminal of the power MOSFET M3, so as to receive a sensed voltage Vs from the gate terminal of M3, and its positive input terminal is connected to circuitry for supplying a reference voltage Vref1.

Figure 2:
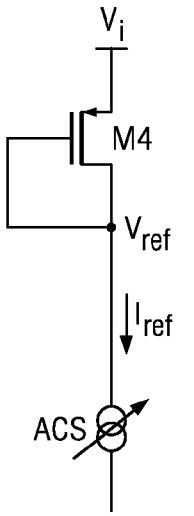
FIG. 2 is a simplified circuit diagram of circuitry for generating a reference voltage in the device according to a preferred embodiment of the present invention.

FIG. 2 shows a circuit diagram of a circuit used to generate the reference voltage Vref1, which basically comprises a PMOS transistor M4 and an adjustable current regulator ACS. The transistor M4 is diode-coupled with its source terminal connected to the input node Vi and an interconnection of its gate and drain terminals coupled to the current regulator ACS. The aspect ratio (W/L ratio) of the transistor M4 should be much less than that of the power MOSFET M3. The adjustable current regulator ACS adjustably regulates the current flowing through the transistor M4 so that the reference voltage Vref at the interconnection of the gate and drain terminals of M4 may be adjusted as required.

When a resistor $R_L$ having a small value (i.e., it represents a high load) is coupled to the output node Vo of the LDO, it draws a high current $I_L$ at the output node Vo. This means that the channel of the power MOSFET M3 is required to be fully open, and thus its gate voltage should be pulled to ground. Accordingly, in this case a low voltage sensed voltage Vs is supplied to the positive input of the comparator CMP, which means that the output of the comparator CMP is high. The control signal output from the comparator CMP then controls S1 to close (switch ON) and S2 to be open (switch OFF). At the same time, the voltage at the positive input of the amplifier is low, since the load $R_L$ is drawing a high current $I_L$. The output of the amplifier AMP and thus the gate voltage of both the transistors M1 and M2 is then low. This means that current flows through the NMOS transistor M1 in the first path to ground and increases the drive of the power MOSFET, allowing the high load to receive a regulated output voltage from the LDO at the output node Vo. If the load coupled to the output node Vo decreases, or there is no load (i.e. there is a large resistor $R_L$), the gate voltage of the power MOSFET M3 increases, thus Vs increases and the output of the comparator CMP becomes low. The control signal from the comparator CMP then controls S1 to open and S2 to close so that the first path is disconnected. The signal input to the positive terminal of the amplifier AMP via the feedback connection FB is then high, since the current $I_L$ drawn by the load resistor $R_L$ has decreased. Therefore current flows through the PMOS transistor M2 in the second path and the gate voltage of the power MOSFET M3 is pulled up towards the supply voltage level. The driver of the present invention may then provide a range of gate voltages to the power MOSFET M3 between ground and the power supply level, depending on the value of the load resistor $R_L$.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

The invention claimed is:

1. An apparatus for providing an output current and an output voltage to a load, the apparatus comprising:

a power transistor that is adapted to be coupled to a load;

a measuring circuit that is coupled to the power transistor, wherein the measuring circuit generates a feedback voltage;

an error amplifier that is coupled to the measuring circuit, wherein the error amplifier compares the feedback voltage to a reference voltage;

an NMOS transistor that is coupled to the error amplifier at its gate and that is coupled to the control electrode at its source on a switching node;

a PMOS transistor that is coupled to the switching node at its source and that is coupled to the error amplifier at its gate;

a charge pump that is coupled the switching node; and a controller that is coupled to the sources of the NMOS and PMOS transistors and to the charge pump, wherein the controller provides a control signal to the charge pump based at least in part on a voltage at the switching node, and wherein the controller includes a comparator having a hysteresis that compares the voltage at the switching node to a second reference voltage.

2. The apparatus of claim 1, wherein the power transistor is a PMOS transistor.

3. The apparatus of claim 1, wherein the charge pump further comprises:

a first switch that is actuated and deactuated by the control signal;

a first current source that is coupled between the first switch and the switching node;

a second switch that is actuated and deactuated by the control signal, wherein the second switch is actuated when the first switch is deactuated, and wherein the second switch is deactuated when the first switch is actuated; and a second current source that is coupled between the second switch and the switching node.

4. The apparatus of claim 1, wherein the measuring circuit further comprises a voltage divider.

5. An apparatus for providing an output current and an output voltage to a load, the apparatus comprising:

a first voltage rail;

a second voltage rail;

a first PMOS transistor that is coupled to the first rail at its source and that is adapted to be coupled to the load at its drain;

a measuring circuit that is coupled to the power transistor, wherein the measuring circuit generates a feedback voltage;

an error amplifier that is coupled to the measuring circuit, wherein the error amplifier compares the feedback voltage to a first reference voltage;

an NMOS transistor that is coupled to the error amplifier at its gate, that is coupled to the first voltage rail at its drain, and that is coupled to the control electrode at its source on a switching node;

a PMOS transistor that is coupled to the switching node at its source, that is coupled to the second voltage rail at its drain, and that is coupled to the error amplifier at its gate;

a first switch that is coupled to the first voltage rail;

a first current source that is coupled between the first switch and the switching node;

a second switch that is coupled to the second voltage rail;

a second current source that is coupled between the second switch and the switching node; and a comparator having a hysteresis, wherein the comparator is coupled to switching node, wherein the comparator compares a voltage at the switching node to a second reference voltage to generate a control signal that is provided to the first and second switches, and wherein the control signal is provided such that the second switch is actuated when the first switch is deactuated and the second switch is deactuated when the first switch is actuated.

6. The apparatus of claim 1, wherein the measuring circuit further comprises a voltage divider.

* * * * *